US008695861B2

(12) United States Patent
Duff

(10) Patent No.: US 8,695,861 B2
(45) Date of Patent: Apr. 15, 2014

(54) STITCHING HEAD

(76) Inventor: William Grady Duff, Lee's Summit, MO (US)

( * ) Notice: Subject to any disclaimer, the term of this patent is extended or adjusted under 35 U.S.C. 154(b) by 101 days.

(21) Appl. No.: 13/211,995

(22) Filed: Aug. 17, 2011

(65) Prior Publication Data

US 2012/0043365 A1 Feb. 23, 2012

Related U.S. Application Data

(60) Provisional application No. 61/374,906, filed on Aug. 18, 2010.

(51) Int. Cl.
*B27F 7/17* (2006.01)

(52) U.S. Cl.
USPC ..... 227/8; 227/131

(58) Field of Classification Search
USPC ..... 227/8, 87, 88, 89, 90, 91, 92, 131, 139, 227/142, 155; 270/52.18
See application file for complete search history.

(56) References Cited

U.S. PATENT DOCUMENTS

| | | | | |
|---|---|---|---|---|
| 2,865,021 | A | 12/1958 | Marzili | |
| 4,485,955 | A * | 12/1984 | Hagemann | 227/89 |
| 5,080,274 | A | 1/1992 | Shea | |
| 5,516,024 | A * | 5/1996 | Hohner et al. | 227/89 |
| 7,337,937 | B2 * | 3/2008 | Klamt et al. | 227/89 |
| 2007/0119898 | A1 * | 5/2007 | Duff | 227/82 |
| 2009/0085272 | A1 * | 4/2009 | Brunner et al. | 270/52.18 |

* cited by examiner

*Primary Examiner* — Michelle Lopez
*Assistant Examiner* — Nathaniel Chukwurah
(74) *Attorney, Agent, or Firm* — Richard P. Stitt; Polsinelli PC

(57) ABSTRACT

A stitching head is provided having a cam connected to the bender rail rail, the cam operates to redirect the staple driving force being applied by the driver rail to the driver and upon the staple during the staple driving step of stitching head operation; the force-redirecting position of the cam is automatically adjusted in response to the thickness of each workpiece as the cam is connected to the bender rail rail and the contacting of the workpiece by the bender rail repositions the cam at the desired distance above the workpiece to reestablish the set-point for the redirection of the staple driving force being applied to the driver rail upon as staple head contacts each variable thickness workpiece.

4 Claims, 7 Drawing Sheets

STITCHING HEAD

CROSS-REFERENCE TO PRIOR APPLICATIONS

This application claims priority to U.S. provisional patent application Ser. No. 61/374,906 filed Aug. 18, 2010 titled Stitching Head.

FIELD OF THE INVENTION

This invention relates to the area of high speed commercial stitching heads used to insert staples into printed material. More particularly, the present apparatus provides a stitching head which automatically adjusts the amount travel applied to the staple driver by the driver rail of the stitching head in response to the thickness of the workpiece presented to the stitching head.

BACKGROUND OF THE INVENTION

It is typical of prior art stitching machines that they require mechanical adjustments to the stitching machine's stitching head actuating or adjustment to the position of the clincher mechanism to accommodate variations in thickness of the workpiece to be stapled. Therefore it would be advantageous if a stitching head could automatically accommodate variations in workpiece thickness without the need for mechanical adjustment of the stitching head actuating bar or clincher mechanism to the stroke distance of the force-providing machine rail.

The cam system and interlock system of the stitching head provided herein accomplishes the accommodation of variable thicknesses of workpieces to be stapled by the stitching head without the need for springs or dampeners. It also will be appreciated that the cam system provided herein maintains consistent workpiece closure—the stapling tightness or compression together of the workpiece material or paper stack that is stapled together—without the use of springs or dampeners.

DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

DESCRIPTION OF THE PREFERRED EMBODIMENT

As required, detailed embodiments of the present inventions are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
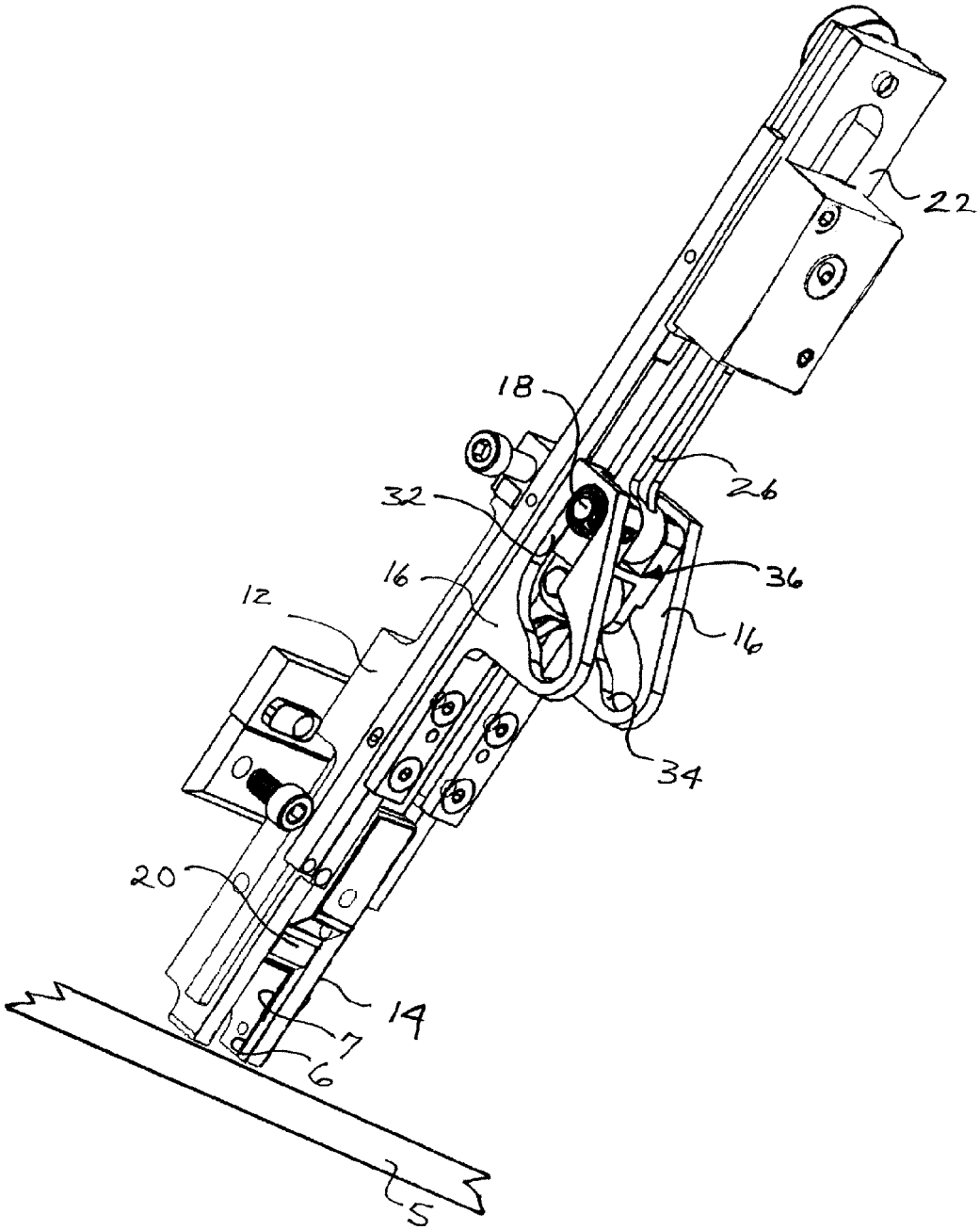
FIG. 1 is a front and left side perspective view of an embodiment showing the cam 16 connected to the bender rail 14 and the transition roller 18 of the cam follower 36 connected between the staple driver or driver 20 and the driver rail 22 and showing the cam follower transition roller 18 positioned in the top most position of the cam 16 path for the beginning of the staple driving step of the staple insertion sequence.

Referring now to FIG. 1, a front and left side view of the bender rail and driver components of a stitching head 10 is shown. A frame piece 12 is provided having a bender rail 14 movably connected thereto. Bender rail 14 is provided with a cam 16 which is connected to bender rail 14. Cam 16, as more completely identified hereinafter, is comprised of a first leg 32 which is a force-applying leg and a second leg 34 which is a force-redirecting leg. The operation and effect of these two cam legs 32, 34 will be further described hereinafter. A cam follower 36 is provided which travels the path of cam 16. The construction and operation of cam follower 36 will be further described hereinafter.

Figure 3:
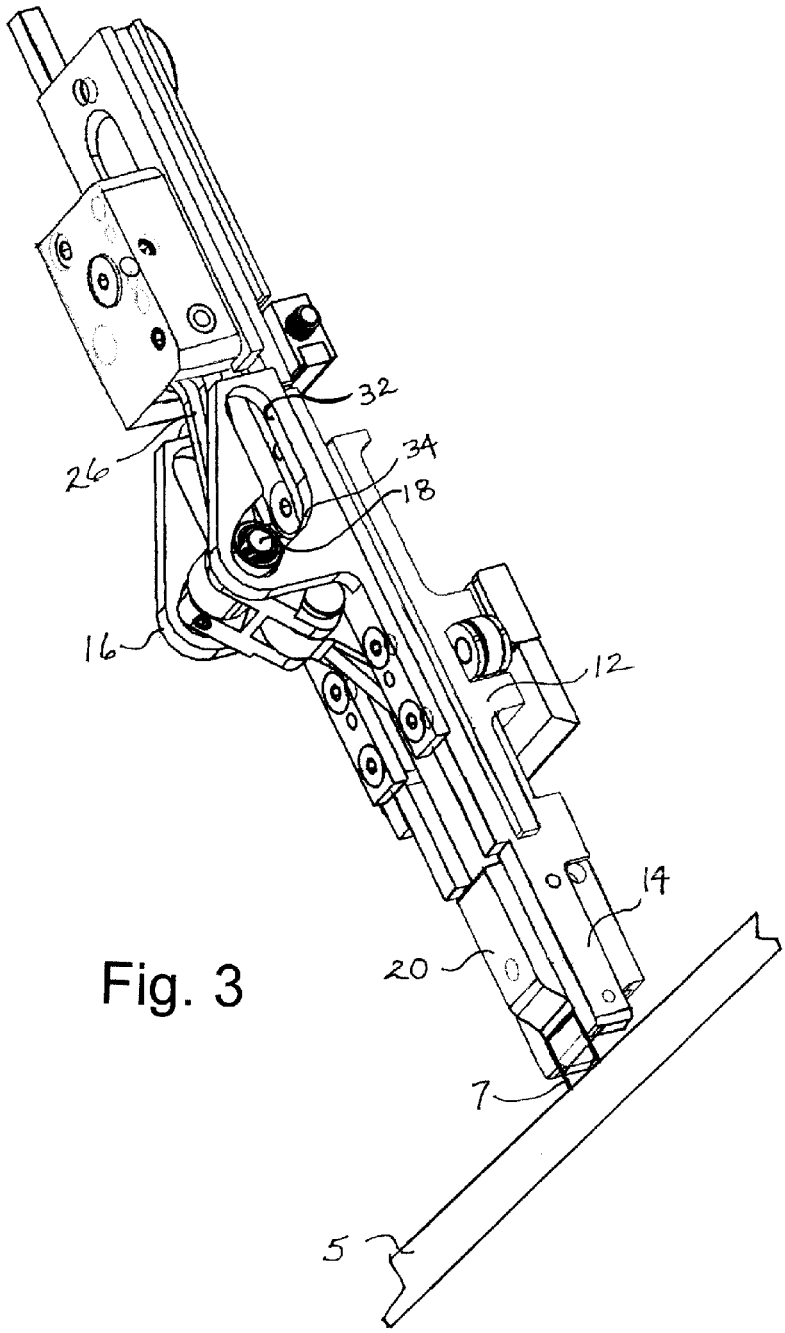
FIG. 3 is a front and right side perspective view of the embodiment of FIG. 1 showing the cam follower transition roller 18 at the end of its travel along the force-applying leg 32 of cam 16 after it has passed from the force-applying leg 32 of the cam 16 and entered the force-redirecting leg 34 of cam 16 wherein the force communicated from the driver rail 22 is redirected into causing the movement of cam follower transition roller 18 of cam follower 36 along the force-redirecting leg 34 of cam 16 thereby ending the communication of staple-insertion force from driver rail 22 to driver 20 as the driver has reached the end of the bender rail 14.
Figure 4:
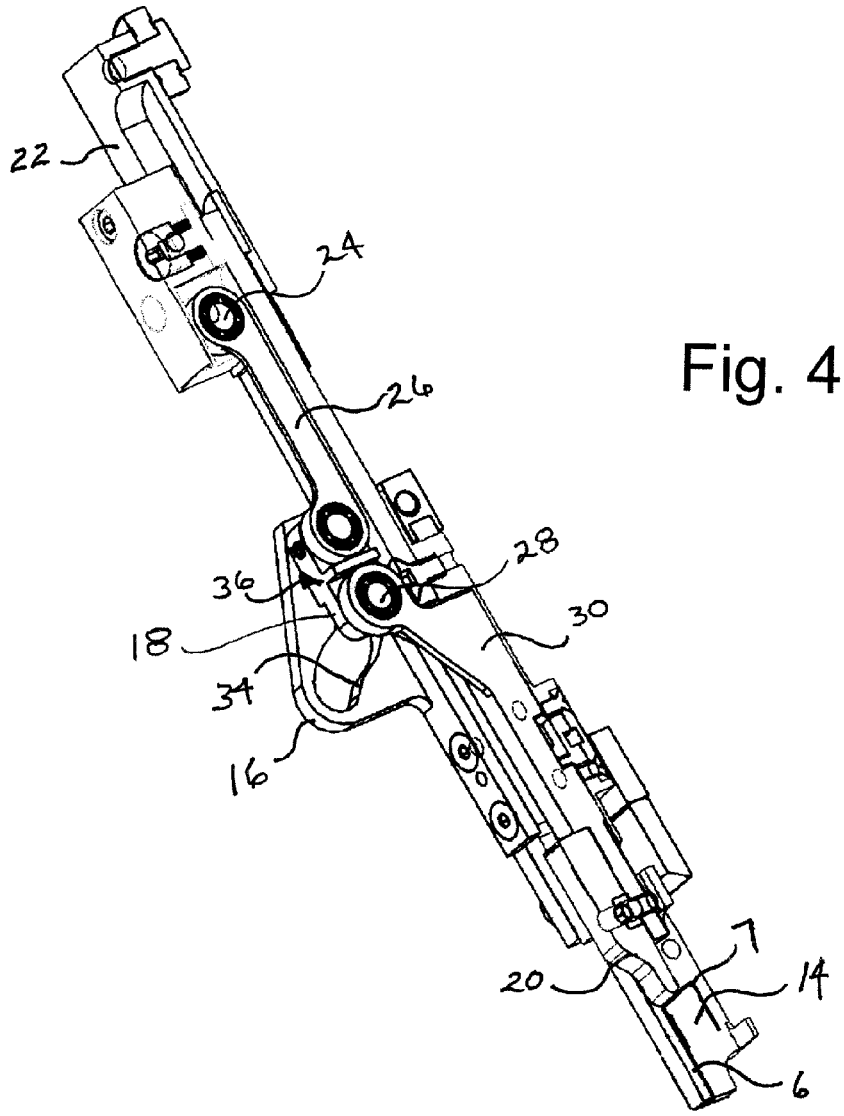
FIG. 4 is a cross-section view taken along line 4-4 of FIG. 1 and showing the cam follower transition roller 18 of cam follower 36 at the top of force-applying leg 32 of cam 16 and which position is immediately prior to the downward movement of cam follower transition roller 18 resulting from the driver rail 22 starting downward movement to move the driver 20 downwardly for insertion of a staple 7.

Still referring to FIG. 1, driver 20 is connected to bender rail 14 and driver 20 slidably moves within tracks 6 on either side of bender rail 14. During operation, a staple 7 is disposed directly below driver 20. Staple 7 also rides in tracks 6. Driver 20 is connected to driver rail 22 by cam follower 36. Referring to FIG. 4, cam follower 36 is comprised of several components that connect driver rail 22 to driver 20. More particularly, cam follower 36 is comprised of a cam follower upper link 26 which is pivotally connected to driver rail 22 by cam follower upper roller 24. Cam follower 36 also has a lower link 30 which is connected to driver 20 by cam follower lower roller 28. Upper link 26 and lower link 30 of cam follower 36 are pivotally connected by cam follower transition roller 18 which extends into cam 16 such that the movement of upper link 26 and lower link 30 comprising cam follower 36 is directed by the pathway formed by cam 16. It is cam follower transition roller 18 which travels along the path presented by cam 16 (FIG. 1). As will be described hereinafter, the position of cam follower 36 as determined by the position of transition roller 18 within cam 16 determines the amount of force that is communicated from driver rail 22 through cam follower 36 and to driver 20. This variation in the application of force will be further described hereinafter with reference to FIGS. 1-4.

Referring now to FIGS. 1-4, the application of force to achieve the insertion of a staple 7 into a work piece 5 (FIG. 1) will be described. First referring to FIG. 1, bender rail 14 is shown extended from frame 12 and in position to contact and compress a work piece 5 prefatory to the insertion of a staple 7 into the work piece 5 by driver 20. Also shown in FIG. 1, driver 20 is in its uppermost position as limited by transition roller 18 of cam follower 36 (FIG. 4) within force-applying leg 32 of cam 16. It will be appreciated that cam 16 is connected to bender rail 14, therefore, the position of cam 16 with respect to frame 12 is determined by the thickness of the work piece 5 which bender rail 14 contacts. It also will be appreciated that as the thickness of work piece 5 increases the vertical distance traveled by driver 20 within bender rail 14 decreases and as a work piece 5 becomes thinner, bender rail 14 is further downwardly extended with respect to frame 12 and the distance traveled by driver 20 becomes greater. This variation in the distance traveled by driver 20 with respect to bender rail 14 as being dependent upon the thickness of a work piece 5 will become clear as the operation of stitch head 10 is further described.

Again referring to FIG. 1, transition roller 18 of cam follower 36 is shown in the uppermost position permitted by cam 16 and which is the position of transition roller 18 and driver 20 just prior to the initiation of a downward stroke for insertion of a staple by stitch head 10. In operation transition roller 18 then moves downwardly from the position shown in FIG. 1. This movement is in response to the downward movement of driver rail 22, the movement of which is governed by the actuating bar (not shown) of the stitching machine (not shown) into which stitch head 10 has been inserted. The downward movement of driver rail 22 is communicated through cam follower 36 and to driver 20 which begins the forcing of a staple 7 into work piece 5. It will be appreciated that the orientation of force-applying leg 32 provides a generally straight-line connection between driver rail 22 and driver 20 thereby communicating the entire force applied to driver rail 22 to driver 20 for the insertion of a staple into a work piece 5. It also will be appreciated by comparing the position of driver 20 in FIG. 1 to the position of driver 20 shown in FIG. 2 that downward movement of driver 20 has been generated as a result of the downward movement of driver rail 22 communicated through transition roller 18 and cam follower 36 as governed by the pathway of cam 16.

Figure 2:
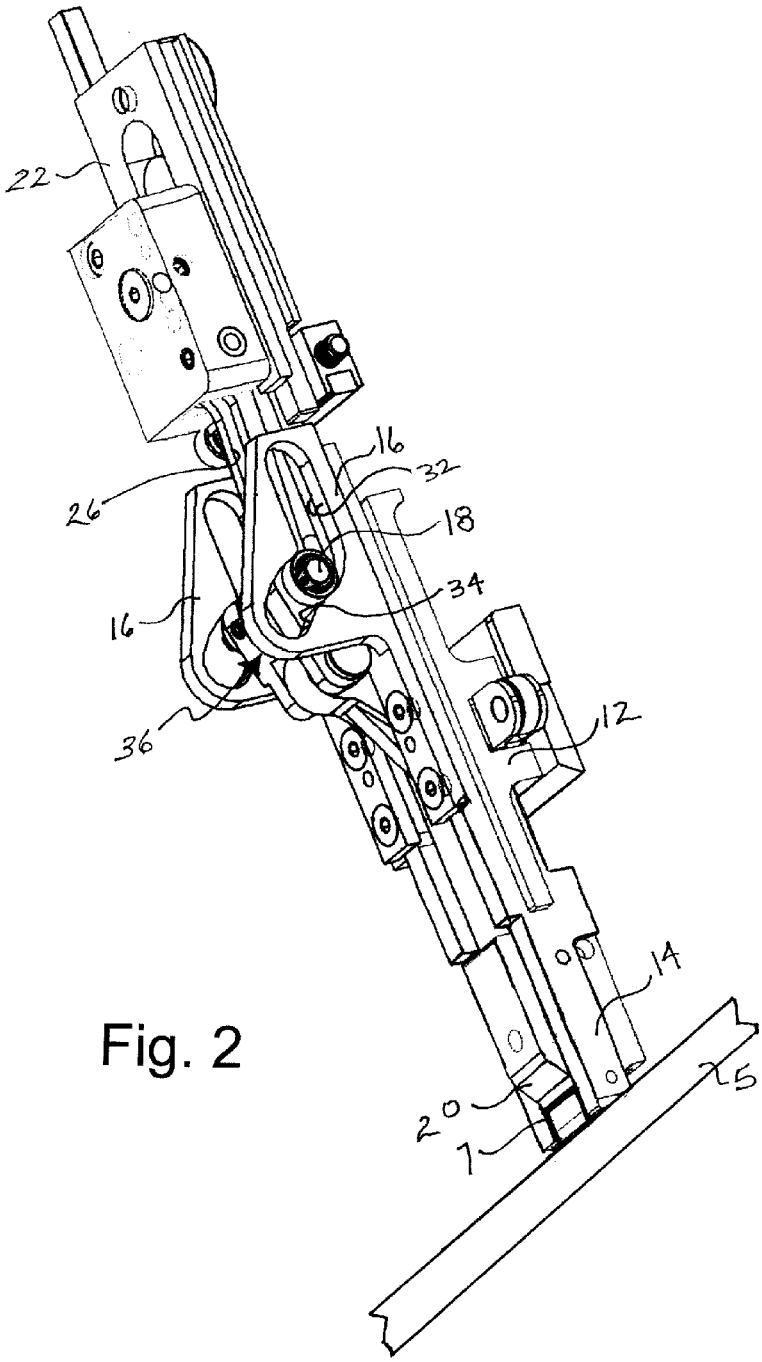
FIG. 2 is a front and right side perspective view of the embodiment of FIG. 1 showing cam follower transition roller 18 approximately at the end of the path of travel along the force-applying leg 32 of the cam 16 and showing the cam follower transition roller 18 approaching the transition to the force-redirecting leg 34 of cam 16, at the position shown in FIG. 2 staple-insertion force is being communicated to the driver 20 from the driver rail 22 via the cam follower 36 and the driver 20 is shown nearer to the end of the bender rail 14.

Referring now to FIG. 2, transition roller 18 of cam follower 36 is in the transition area at which the path established by cam 16 changes from a force-applying leg 32 into a force-redirecting path established by force-redirecting leg 34 of cam 16. It will be appreciated by a comparison of the position of driver 20 in FIG. 2 with the position shown in FIG. 1 that downward progress of driver 20 has occurred as transition roller has been further moved along force-applying leg 32 of cam 16 by driver rail 22.

As transition roller 18 enters the initial portion of force-redirecting leg 34 of cam 16 and driver 20 is shown nearly to the end of bender rail 14 at which point the crown (the portion that connects the two legs of the staple) of staple 7 would be in contact with the work piece 5. With the staple crown in contact with the work piece, further downward driving of the staple 7 into the work piece 5 can be terminated. As transition roller 18 moves further along force-redirecting leg 34 of cam 16 the position of driver 20 becomes even with the end of bender rail 14. It is at this position of driver 20 that the crown of a staple 7 would be pressed against work piece 5 and the termination of downward force by driver 20 against the staple crown should occur. Terminating additional downward force will avoid pressing the staple crown into the work piece and/or through the work piece 5 thereby causing damage to the work piece and a stitching failure. To avoid further downward pressure against the staple by driver 20 the force being applied by driver rail 22 either must be terminated or redirected to avoid the further application of force to a staple being inserted by driver 20. This redirection of force is accomplished by further movement of cam follower 36 along force-redirecting leg 34 of cam 16 as shown in FIG. 3. In the end position of force-redirecting leg 34 no further downward movement of driver 20 occurs even though additional downward movement of driver rail 22 occurs and transition roller 18 travels farther along force-redirecting leg 34 of cam 16.

It is the movement of cam follower transition roller 18 along force-redirecting leg 34 of cam 16 that redirects the force being applied by driver rail 22 and avoids further downward movement of driver 20 and further insertion of a staple into work piece 5. Inspection of the shape of cam 16 as shown in FIGS. 1-4 shows that the path of force-applying leg 32 of cam 16 is generally in a straight line with, or parallel to, the direction of travel of driver rail 22. In contrast, the path of force-redirecting leg 34 of cam 16 changes to a direction that is approximately 22 degrees from the path of force-applying leg 32. This change in path direction results in the downward force from driver rail 22 being redirected along the path established by force-redirecting leg 34 with some of the force being put to the purpose of pivoting the force-applying leg 32 and the force-redirecting leg 34 about cam follower transition roller 18. This redirection of the force being delivered by driver rail 22 results in reduction and termination of the downward movement of driver 20 and the force delivered to driver 20 from driver rail 22.

Figure 5:
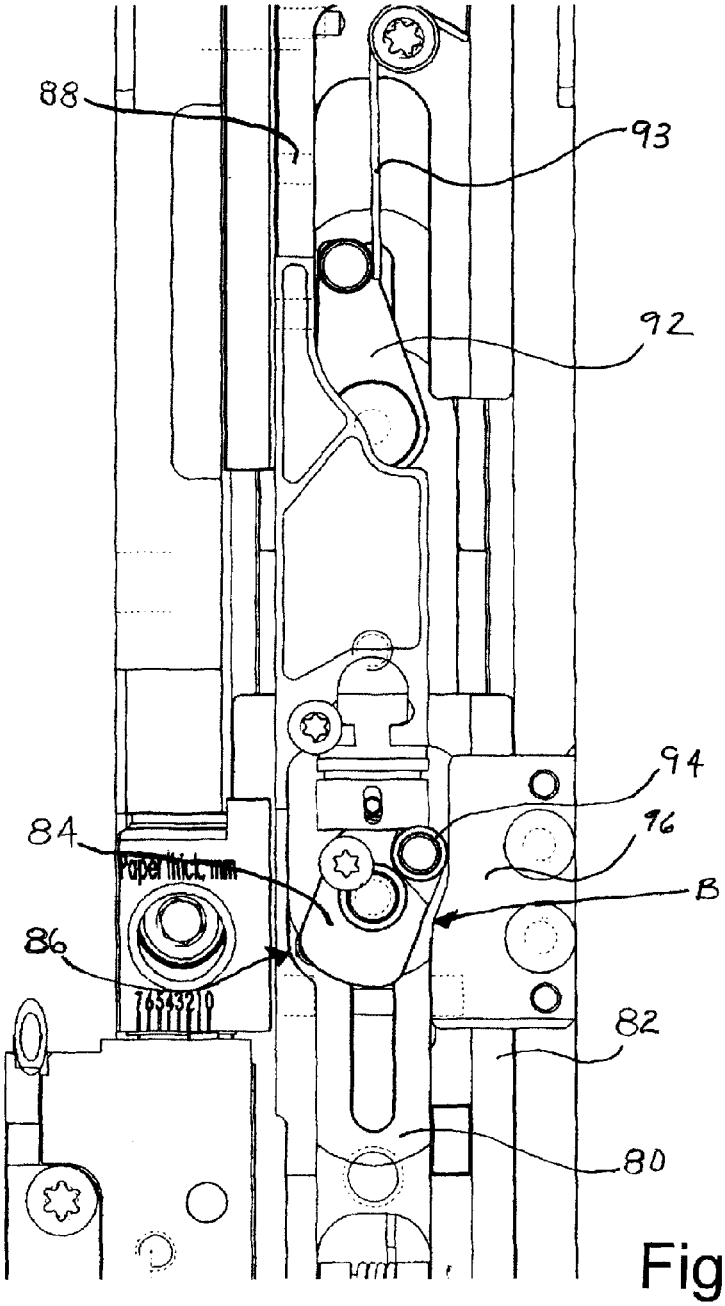
FIG. 5 is a front elevation view of a another stitching head embodiment for preventing the delivery of excess drive rail force to the driver and showing the first flange 84 and the second flange 92 both in the locked position.
Figure 6:
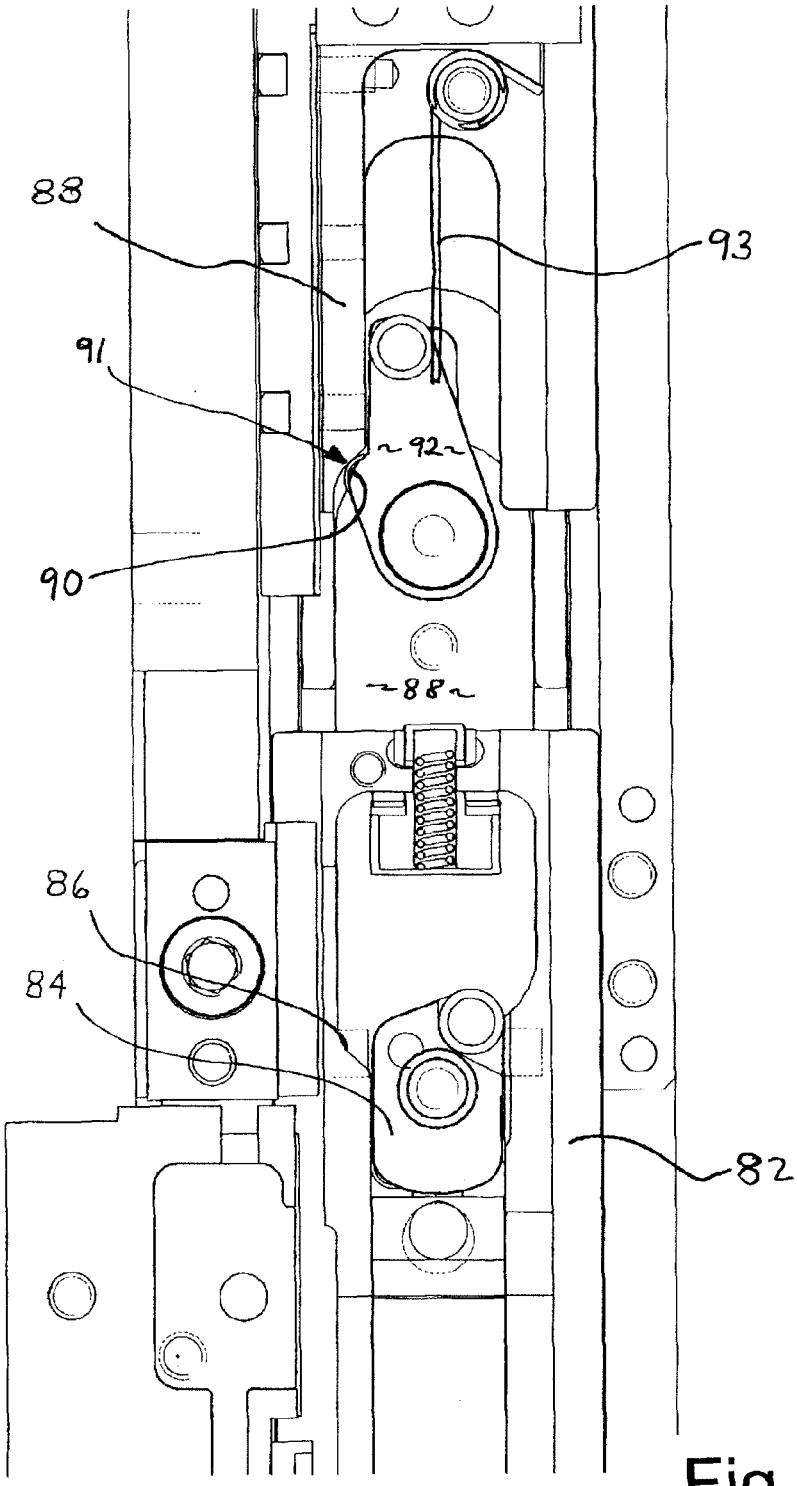
FIG. 6 is a front elevation view of the stitching head of FIG. 5 and showing the first flange 84 in the unlocked position and the second flange 92 in the locked position.

Interlock and Release Mechanism for Engagement of Bender Rail with Driver for Driver Rail with Driver Referring now to FIG. 5 an embodiment is shown for the releasable interlocking or engagement of bender rail 82 with driver 80 and for the releasable interlocking or engagement of for drive rail 88 with driver 80 during the staple insertion process. It will be appreciated that while different reference numbers are now employed the continuation of the same or similar structure names as used on FIGS. 1-4 is intended to reference the same or similar structures as was presented previously in those figures. In FIG. 5 driver 80 is shown interlocked with bender rail 82 as flange 84 is spring biased, or mechanically pressed, to be rotated to contact shoulder 86 of bender rail 82 thereby connecting the bender rail 82 with the driver 80 for joint movement as the driver 80 receives force from the driver rail 88. Also shown in FIGS. 5 and 6 is the interlocking of driver 80 with driver rail 88 by the abutting of hip 90 (FIG. 6) of flange 92 on shoulder 91 of driver rail 88. It will be appreciated by those skilled in the art that with bender rail 82 and driver 80 and drive rail 88 connected together that the downward motion of these structures begins the formation of the staple 7 (FIG. 1) as the force from the actuator bar (not shown) is communicated through the drive rail 88 to the bender rail 82 to shape wire into a staple having a crown and two legs extending from either end of the crown.

Still referring to FIGS. 5 and 6, driver 80 is released from engagement with bender rail 82. The disengagement is achieved as the result of cam follower 94 on flange 84 being pressed inwardly to caused flange 84 to be rotated off of shoulder 86 as cam follower 94 arrives at Point B on cam 96. This allows driver 80 to continue to move separately from bender rail 82 to continue downward movement to force the staple through the workpiece. Bender rail 82 has previously ended its movement downward upon bender rail 82 contacting the workpiece (not shown).

Figure 7:
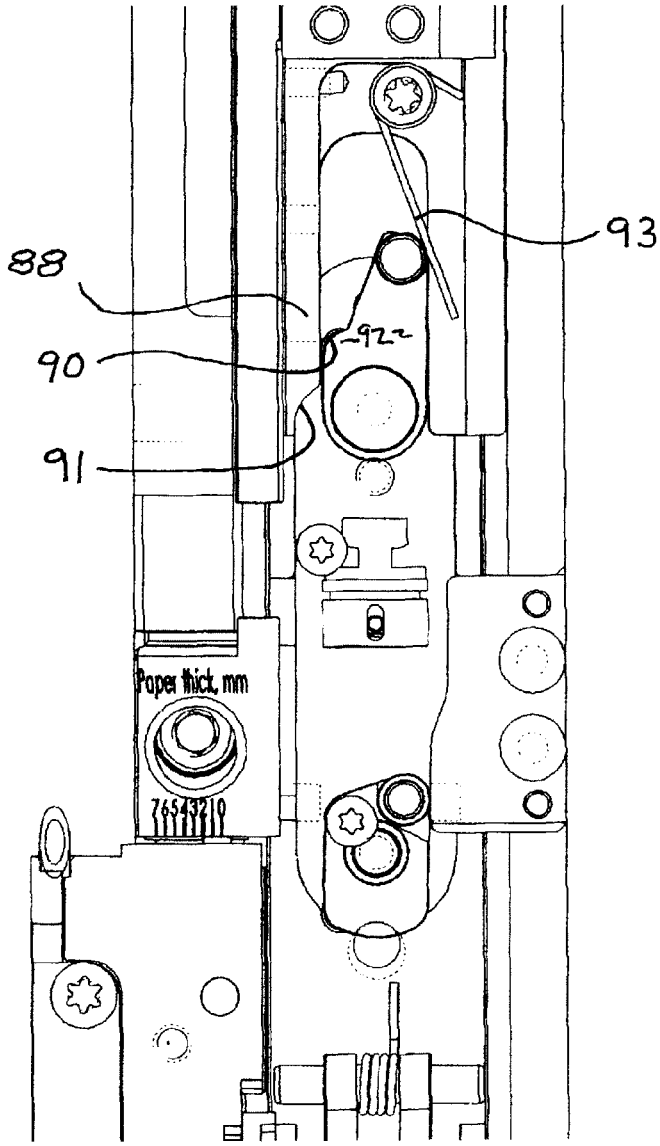
FIG. 7 is a front elevation view of the stitching head of FIG. 5 and showing the first flange 84 and the second flange 92 both in the unlocked position.

In FIGS. 6 and 7, driver 80 is unlocked from driver rail 88 by the rotation and release of hip 90 of flange 92 from engagement or interlock with shoulder 91 on driver rail 88. This disengagement or release occurs when driver 80 reaches the end or tip of bender rail 82 which is in contact with the workpiece 5. It is at this point in the operation of stitching head 10 that the staple 7 has been inserted into the workpiece 5 and further downward movement of driver 80 is not needed and would cause the staple 7 to be driven too far into the work piece 5.

The increased resistance driver 80 receives upon contacting the workpiece 5 at the conclusion of the staple 7 insertion is sufficient to urge flange 92 to move hip 90 along shoulder 91 which results in the rotation of flange 92 against flexible rod 93 which has, up to this point in the operation, biased hip 90 of flange 92 against shoulder 91. This rotation of flange 92 allows the disengagement of hip 90 from shoulder 91 and the disengagement of driver 80 from driver rail 88. As a result driver 80 is released from drive rail 88 and the additional downward movement of the driver rail 88 as caused by the actuator bar (not shown) does not transmit force to the driver 80.

I claim:

1. stitching head comprising:

a frame having a driver rail mounted thereon, the driver rail connected to a staple driver by a cam-follower, the cam-follower having an upper link pivotally connected to the driver rail and a lower link pivotally connected to the staple driver the upper link and the lower link being pivotally connected together by a transition roller, the transition roller extending to engage a cam, the cam having a driving force communicating leg operable to communicate a staple driving force from the driver rail to the staple driver, the cam having a driving force diverting leg extending at an obtuse angle from the a downward path of the driving force communicating leg, a redirecting leg path extending until the reversal of cam follower movement and operable to reduce the amount of staple driving force that is communicated by the cam follower from the driver rail to the staple driver, and a bender rail connected to the cam, the cam and bender rail being slidably mounted on the frame such that the bender rail and cam are displaced along the frame in response to the thickness of the workpiece contacted by the bender rail to change the amount of distance the cam-follower travels along the driving force communicating leg of the cam prior to the cam follower entering the driving force diverting leg of the cam.

2. A stitching head comprising:

a frame having slidably mounted thereon a driver rail and a bender rail and a driver, a driver-bender rail interlock for releasable connecting the driver to the bender rail, the driver-bender rail interlock comprising a rotatable flange plate connected to the driver the flange plate rotating to engage a shoulder on the bender rail to communicate a downward force from the driver to the bender rail, a cam extending from the bender rail to engage a cam follower on the flange plate the cam acting on the cam follower to rotate the flange for release of the flange from engagement with the shoulder to terminate the downward movement of the bender rail and to allow continued downward movement of the driver for insertion of the stable into the workpiece.

3. A stitching head driver rail and staple driver engagement and release apparatus to allow a driver rail to communicate staple driving force to a staple driver comprising:

a rotatable flange plate connected to the driver, a hip extending from the flange plate, and a flexible rod extending to contact the flange plate to rotate the flange plate to bias the hip of the flange plate against a shoulder of the driver rail to engage the driver with the driver rail for communication of downward staple driving force from the driver rail to the driver, the driver being responsive to resistance from driver contact against the workpiece to communicate an upward force to the hip to disengage the hip from the shoulder of the driver rail to release the driver from engagement with the driver rail to terminate the downward force of the driver against the staple.

4. A stitching head engagement and release apparatus for releasable engagement of the driver rail with the staple driver and releasable engagement of the bender rail and the stable driver to allow a driver rail to communicate staple driving force to a staple driver and to terminate the staple driving force in response to changes in the thickness of the workpiece the apparatus comprising:

a frame having slidably mounted thereon a driver rail and a bender rail and a driver, a driver-bender rail interlock for releasable engagement of the driver with the bender rail the driver-bender rail interlock comprising a rotatable flange plate connected to the driver, the flange plate rotating to engage a shoulder on the bender rail to communicate a downward force from the driver to the bender rail, a cam extending from the bender rail to engage a cam follower on the flange plate the cam acting on the cam follower to rotate the flange for release of the flange from engagement with the shoulder to terminate the downward movement of the bender rail and to allow continued downward movement of the driver for insertion of the stable into the workpiece, a driver-driver rail interlock for releasable connecting the driver to the driver rail the driver-driver rail interlock comprising a rotatable flange plate connected to the driver, a hip extending from the flange plate, and a flexible rod extending to contact the flange plate to rotate the flange plate to bias the hip of the flange plate against a shoulder of the driver rail to engage the driver with the driver rail for communication of downward staple driving force from the driver rail to the driver, the driver being responsive to resistance from driver contact against the workpiece to communicate an upward force to the hip to disengage the hip from the shoulder of the driver rail to release the driver from engagement with the driver rail to terminate the downward force of the driver against the staple.

* * * * *